US008468855B2

(12) United States Patent
Chen et al.

(10) Patent No.: US 8,468,855 B2
(45) Date of Patent: Jun. 25, 2013

(54) DOWNWARD PRESSING MESH MECHANISM AND SINKER THEREOF FOR FLAT KNITTING MACHINES

(75) Inventors: Yi-Chen Chen, New Taipei (TW); Kai-Ying Cheng, New Taipei (TW); Jian-Hao Peng, New Taipei (TW)

(73) Assignee: Pai Lung Machinery Mill Co., Ltd., New Taipei (TW)

( * ) Notice: Subject to any disclaimer, the term of this patent is extended or adjusted under 35 U.S.C. 154(b) by 34 days.

(21) Appl. No.: 13/235,137

(22) Filed: Sep. 16, 2011

(65) Prior Publication Data

US 2013/0067964 A1 Mar. 21, 2013

(51) Int. Cl.
*D04B 15/06* (2006.01)

(52) U.S. Cl.
USPC ..... 66/106

(58) Field of Classification Search
USPC ..... 66/60 R, 64, 75.2, 75.1, 104, 106
See application file for complete search history.

(56) References Cited

U.S. PATENT DOCUMENTS

| | | | | |
|---|---|---|---|---|
| 5,134,864 | A * | 8/1992 | Yabuta et al. | 66/106 |
| 5,134,865 | A * | 8/1992 | Shima et al. | 66/106 |
| 5,231,854 | A * | 8/1993 | Schmid et al. | 66/64 |
| 5,280,712 | A * | 1/1994 | Nakamori et al. | 66/106 |
| 5,333,473 | A * | 8/1994 | Miyamoto | 66/106 |
| 5,408,849 | A * | 4/1995 | Schimko et al. | 66/106 |
| 5,475,991 | A * | 12/1995 | Yabuta et al. | 66/106 |
| 5,570,592 | A * | 11/1996 | Takegawa | 66/64 |
| 5,918,483 | A * | 7/1999 | Schmid et al. | 66/64 |
| 6,014,874 | A * | 1/2000 | Shima et al. | 66/106 |
| 6,079,233 | A * | 6/2000 | Shima | 66/106 |
| 6,092,396 | A * | 7/2000 | Schmid et al. | 66/106 |
| 6,568,222 | B1 * | 5/2003 | Morita | 66/106 |
| 7,174,748 | B2 * | 2/2007 | Sonomura | 66/106 |
| 7,380,419 | B2 * | 6/2008 | Miyamoto | 66/106 |
| 7,963,127 | B2 * | 6/2011 | Stingel | 66/106 |

FOREIGN PATENT DOCUMENTS

| | | |
|---|---|---|
| TW | 338440 | 8/1998 |
| TW | I274796 | 3/2007 |

* cited by examiner

*Primary Examiner* — Danny Worrell
(74) *Attorney, Agent, or Firm* — Muncy, Geissler, Olds & Lowe, PLLC

(57) ABSTRACT

A downward pressing mesh mechanism and sinker thereof for flat knitting machines in which the downward pressing mesh mechanism includes a needle seat containing a bearing surface to hold a plurality of sinkers and knitting needles separated by spacers and a cam holder located above the sinkers to hold a cam. The cam has a guide track to drive the sinkers swinging. The spacers are vertically run through by a bracing shaft at a lower side. Each sinker includes a yarn pressing portion to press a yarn to form a mesh, a swing guide portion driven by the guide track and a shaft rotating recess to couple with the bracing shaft. The sinker thus structured is simpler and durable, hence can be produced and assembled, or repaired and replaced easier and faster. Thus manpower and material costs can be reduced, and product prices also are decreased to meet market requirements.

14 Claims, 6 Drawing Sheets

DOWNWARD PRESSING MESH MECHANISM AND SINKER THEREOF FOR FLAT KNITTING MACHINES

FIELD OF THE INVENTION

The present invention relates to a flat knitting machine mechanism and components thereof and particularly to a mechanism to press a yarn to form a mesh and a sinker thereof for flat knitting machines.

BACKGROUND OF THE INVENTION

When a protrusive pattern cloth (i.e. jacquard fabric) is knitted via a conventional flat knitting machine, sinkers are swung about a shaft to press a yarn downwards to form a mesh to knit the protrusive pattern cloth.

For instance, R.O.C. patent No. 338440 entitled "Improved sinker for flat knitting machines" discloses a sinker 10 is braced by a bracing rod 22 to achieve swinging.

When a flat knitting machine is in production and assembly, the sinkers 10 have to be run through individually by the bracing rod 22 for coupling. Moreover, during repair and maintenance, the sinkers 10 also have to be removed individually for replacement as needed, and then reassembled individually again. It is troublesome, tedious and time-consuming.

R.O.C. patent No. 1274796 entitled "Sinker for flat knitting machines to downward press mesh" discloses a sinker 1 with a slot 19 threaded through by a loosening yarn 45 of the mesh as shown in its FIG. 1. The sinkers 1 have to be individually threaded through by the loosening yarn 45 of the mesh and also be removed individually therefrom to replace the broken one during repair and maintenance. After a new sinker 1 has been replaced, the loosening yarn 45 of the mesh has to thread through all the sinkers 1 again. The process also is troublesome and time-consuming.

In short, while the aforesaid conventional techniques provide retaining shaft swinging function, they still have drawbacks, notably:

1. During production and assembly of the downward pressing mesh mechanism in the conventional flat knitting machine, assembly of the sinkers is troublesome and time-consuming.

2. During repair and maintenance of the downward pressing mesh mechanism in the conventional flat knitting machine, replacement of the sinkers also is difficult and tedious.

3. Due to assembly of the sinkers of the downward pressing mesh mechanism in the conventional flat knitting machine is troublesome and time-consuming, labor cost is higher to result in higher product price, thus cannot meet market requirements.

SUMMARY OF THE INVENTION

The primary object of the present invention is to solve the aforesaid disadvantages by providing a simpler and more durable sinker structure that can be produced and assembled or repaired, maintained and replaced easily and quickly to reduce manpower and material costs and also lower price to meet market requirements.

To achieve the foregoing object, the present invention provides a downward pressing mesh mechanism for flat knitting machines that includes a needle seat containing a bearing surface to hold a plurality of sinkers and knitting needles at an upper side that are separated by spacers, and a cam holder located above the sinkers to hold a cam. The cam has a guide track to drive the sinker swinging. The spacers have a lower side vertically run through by a bracing shaft. Each sinker includes a yarn pressing portion to press a yarn to form a mesh, a swing guide portion driven by the guide track, and a shaft rotating recess to couple with the bracing shaft.

In one aspect the shaft rotating recess includes a shaft coupling portion to couple with the bracing shaft and a neck located at an entrance of the shaft coupling portion that is formed at an interval smaller than the diameter of the bracing shaft.

In another aspect the spacers are vertically run through at an upper side by a retaining rod, and the sinker includes a first retaining portion restricted by the bearing surface when the sinker rotates and swings downwards and a second retaining portion restricted by the retaining rod when the sinker rotates and swings upwards.

In yet another aspect the spacers are vertically run through by a guiding rod and the sinker has a guiding notch with a guiding surface formed thereon to guide and limit rotating and swinging positions of the sinker.

In another aspect the sinker further includes a groove close to the shaft rotating recess and an elastic tongue formed between the groove and the shaft rotating recess.

To achieve the foregoing object, the invention also provides a sinker for flat knitting machines that has a shaft rotating recess at the bottom, a protrusive swing guide portion at an upper side, and a yarn pressing portion extended from one side beyond a line connecting the swing guide portion and shaft rotating recess to press a yarn to form a mesh.

In one aspect the shaft rotating recess includes a shaft coupling portion and a neck located at an entrance of the shaft coupling portion and formed at an interval slightly smaller than the maximum interval of the shaft coupling portion.

In another aspect the sinker has a first retaining portion between the shaft rotating recess and yarn pressing portion.

In yet another aspect the sinker has a guiding notch at another side beyond a line connecting the swing guide portion and shaft rotating recess that has an arched guiding surface at a lower side, and a second retaining portion located between the guiding notch and swing guide portion.

In another aspect the sinker has a groove close to the shaft rotating recess and an elastic tongue formed between the groove and the shaft rotating recess.

By means of the features set forth above the present invention provides many advantages over the conventional techniques, notably:

1. During production and assembly of the downward pressing mesh mechanism, the sinkers can be assembled in the downward pressing mesh mechanism by direct insertion, thus is easier and faster.

2. During repair and maintenance of the downward pressing mesh mechanism, the old sinker can be directly removed in the downward pressing mesh mechanism and replaced with a new one, thus process also is easier and faster.

3. Since the sinkers can be assembled easier and faster, labor cost is lower and product price also can be reduced to meet market requirements.

4. The sinker of the invention can be integrally formed, hence design and structure are simpler and more durable, and material cost can also be reduced to lower the product price to meet market requirements.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
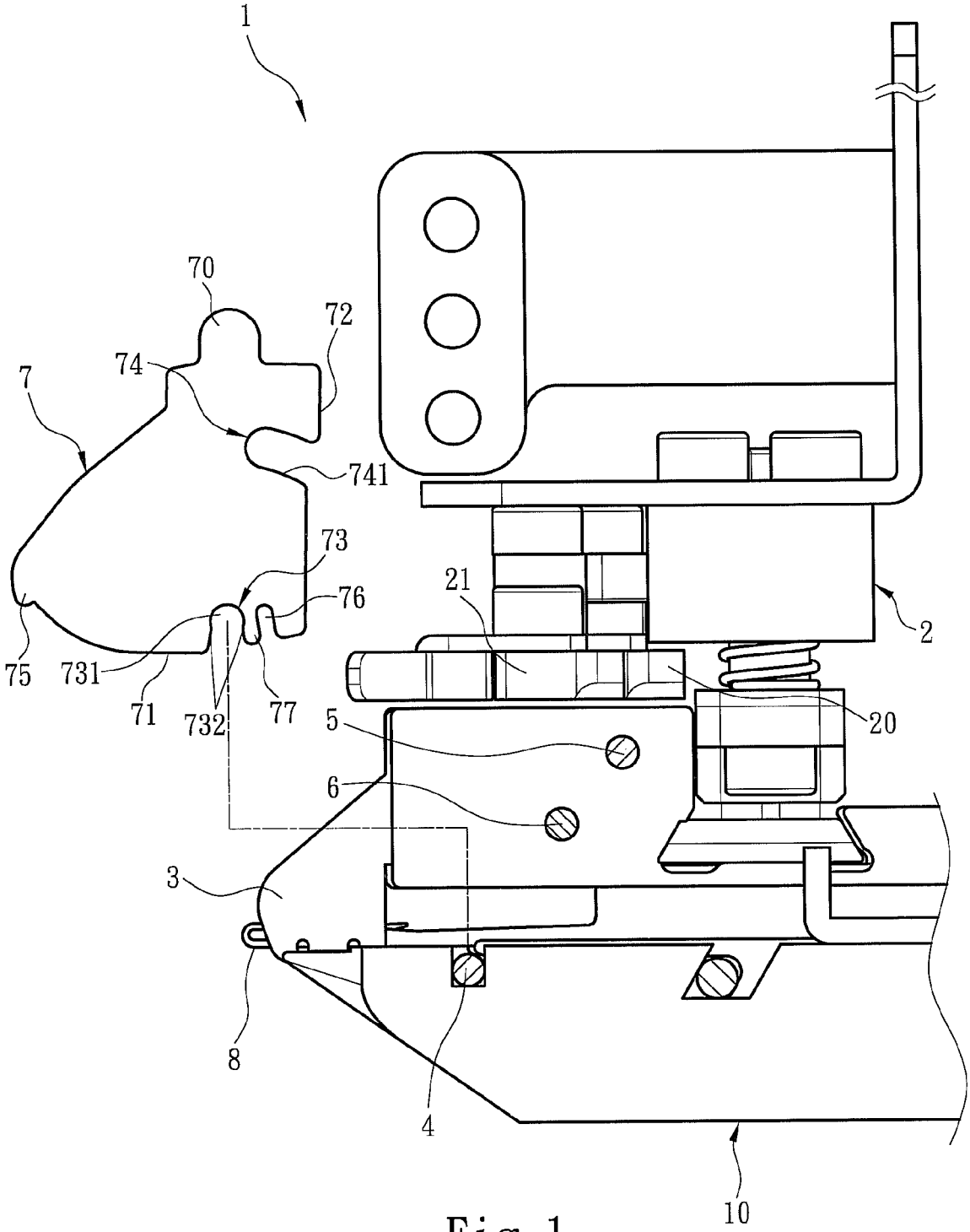
FIG. 1 is a plane view of an embodiment of the invention before assembly.
Figure 2:
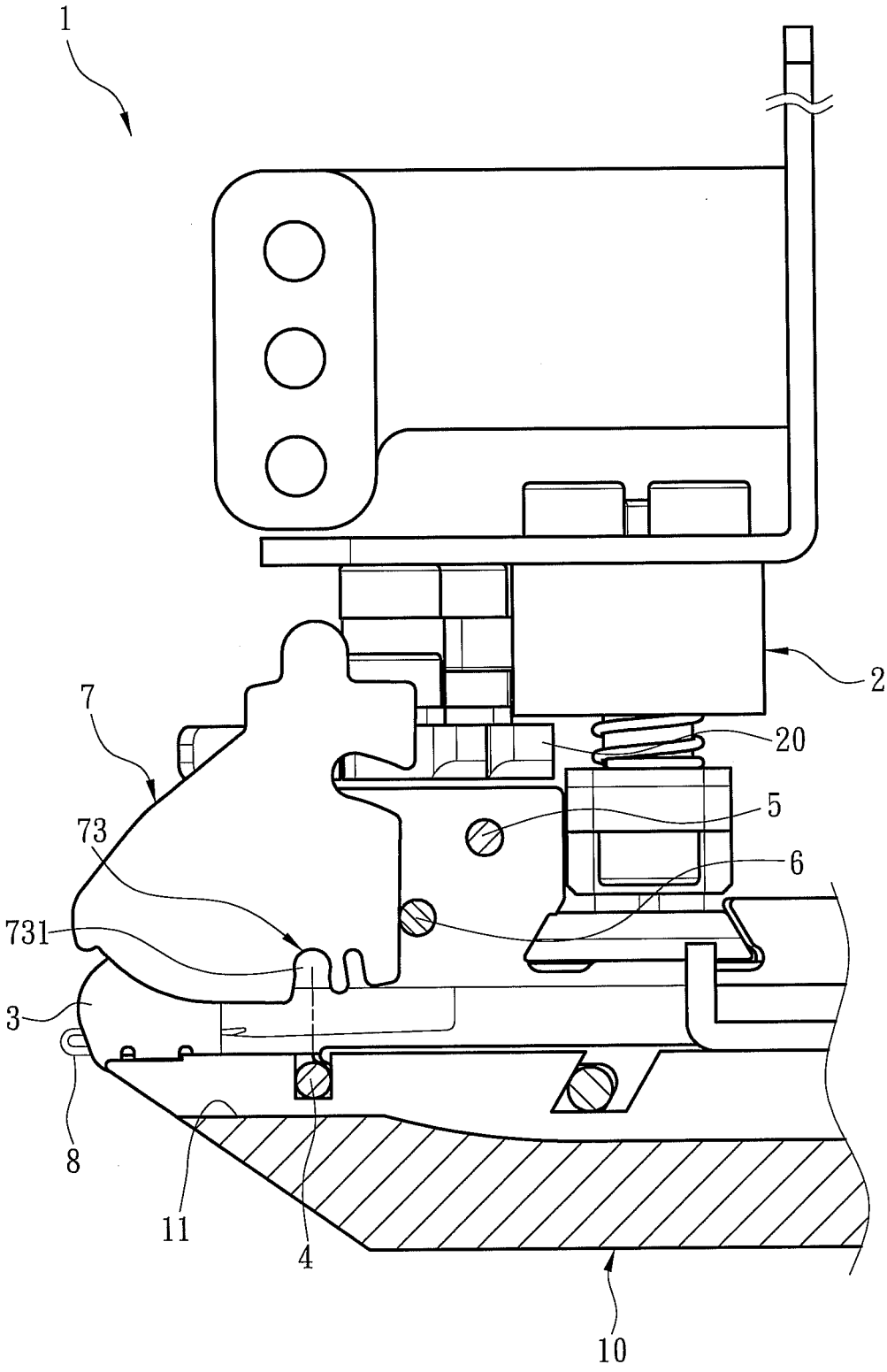
FIG. 2 is a schematic view according to FIG. 1 in an assembly condition.
Figure 3:
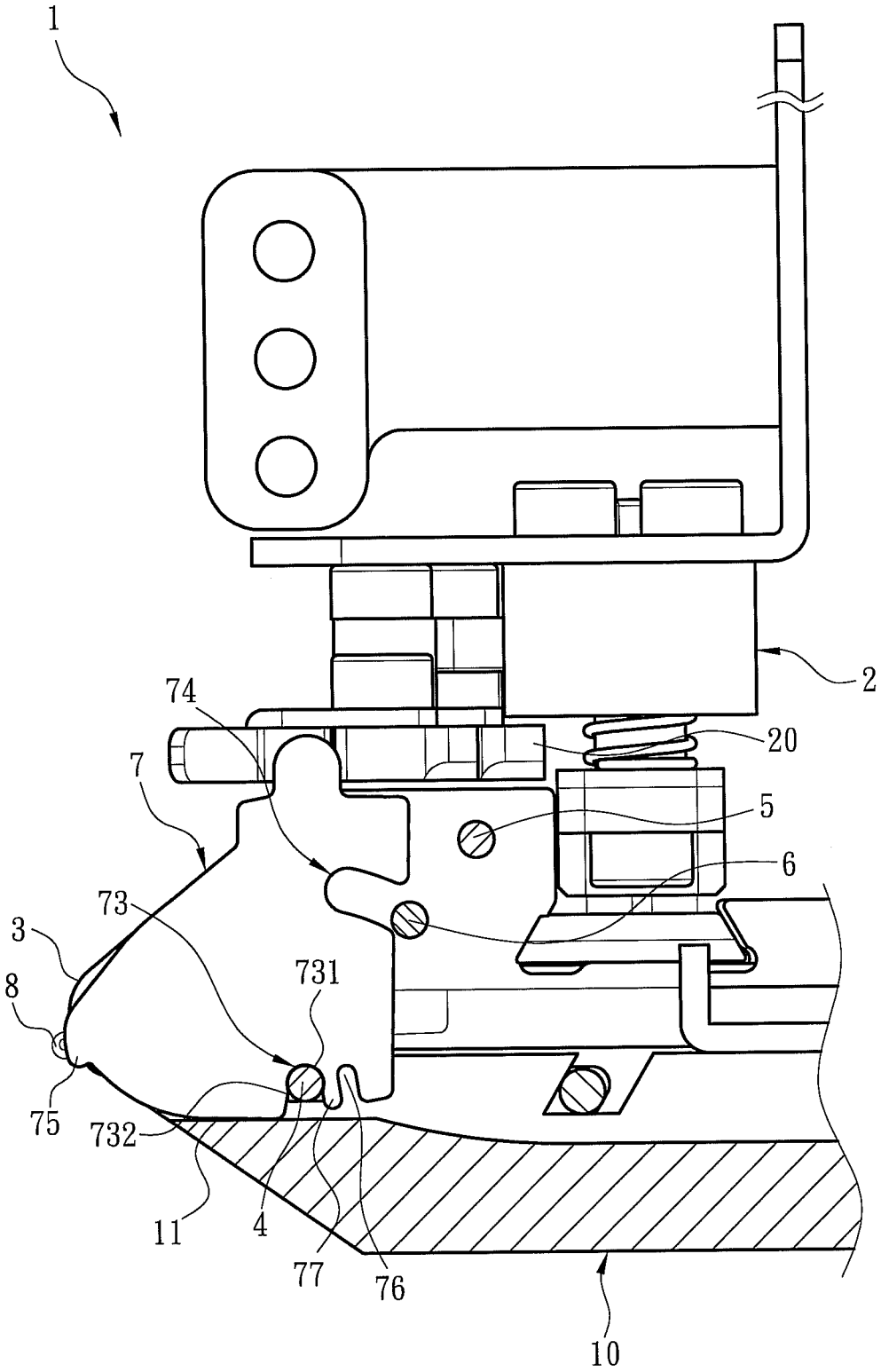
FIG. 3 is a schematic view according to FIG. 2 in another assembly condition.

Please refer to FIGS. 1, 2 and 3, the present invention aims to provide a downward pressing mesh mechanism for flat knitting machines. The downward pressing mesh mechanism 1 includes a needle seat 10 which has a bearing surface 11 to hold a plurality of sinkers 7 and knitting needles 8 separated by spacers 3. As also known in the conventional techniques, the sinkers 7, spacers 3 and knitting needles 8 are arranged sequentially and horizontally above the bearing surface 11 in a juxtaposed manner with a specific number required, and each knitting needle 8 is movable within a space formed by two sinkers 7, and the sinkers 7 also are movable in the separated space. There is a cam holder 2 above the sinkers 7 to hold a cam 20. The cam 20 has a guide track 21 to drive the sinkers 7 swinging. The guide track 21 is not formed in a straight line but at a curve depending on the requirement of knitting fabrics, thereby to drive the sinkers 7 swinging. This is also a technique known in the art. The spacers 3 are vertically run through at the lower side by a bracing shaft 4. Each sinker 7 includes a yarn pressing portion 75 to press a yarn to form a mesh, a swing guide portion 70 driven by the guide track 21 that is preferably formed in a curved shape, and a shaft rotating recess 73 to couple with the bracing shaft 4. The yarn pressing portion 75 is protruded from one side beyond a line connecting the swing guide portion 70 and shaft rotating recess 73 and corresponds to a yarn hooking portion of the knitting needle 8 to press the yarn to form the mesh. The shaft rotating recess 73 includes a shaft coupling portion 732 to couple with the bracing shaft 4 and a neck 731 located at an entrance of the shaft coupling portion 732 that is formed at an interval slightly smaller than the diameter of the bracing shaft 4. The spacers 3 are vertically run through at the upper side by a retaining rod 5. The sinker 7 further has a first retaining portion 71 restricted by the bearing surface 11 during rotating and swinging downward, and a second retaining portion 72 restricted by the retaining rod 5 during rotating and swinging upward. The spacers 3 further are vertically run through by a guiding rod 6. The sinker 7 further has a guiding notch 74 which has a guiding surface 741 to guide and limit rotating and swinging positions of the sinker 7. The guiding surface 741 is preferably an arched surface. Finally, the sinker 7 also has a groove 76 close to the shaft rotating recess 73 and an elastic tongue 77 between the groove 76 and the shaft rotating recess 73. As shown in FIGS. 1, 2 and 3, during production, assembly or repairs and maintenance, the sinker 7 can be easily and quickly assembled or changed to reduce manpower and material costs, and also reduce the price to meet market requirements.

Figure 4:
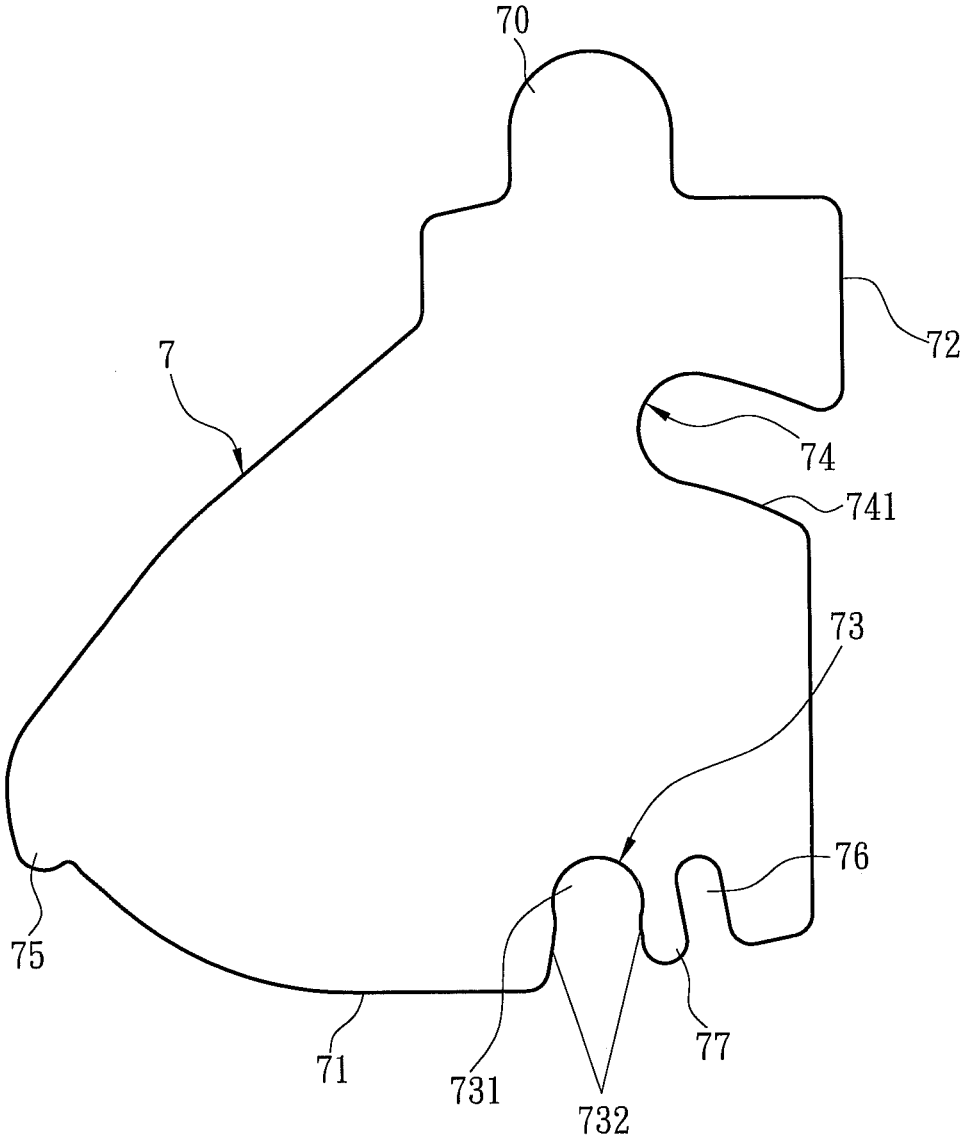
FIG. 4 is an enlarged plane view of an embodiment of a sinker of the invention.

Also referring to FIG. 4, the present invention also provides a sinker for flat knitting machines. The sinker 7 has a shaft rotating recess 73 at the bottom, a curved swing guide portion 70 extended from the upper side, and a yarn pressing portion 75 protruded from one side beyond a line connecting the swing guide portion 70 and shaft rotating recess 73 to press a yarn to form a mesh. The shaft rotating recess 73 includes a shaft coupling portion 732 and a neck 731 at the entrance of the shaft coupling portion 732 and formed at an interval slightly smaller than the maximum interval of the shaft coupling portion 732. There is a first retaining portion 71 located between the shaft rotating recess 73 and yarn pressing portion 75. The sinker 7 also has a guiding notch 74 at another side beyond the line connecting the swing guide portion 70 and shaft rotating recess 73. The guiding notch 74 has an arched guiding surface 741 on a lower side. There is further a second retaining portion 72 between the guiding notch 74 and swing guide portion 70. The sinker 7 further has a groove 76 close to the shaft rotating recess 73 and an elastic tongue 77 between the groove 76 and shaft rotating recess 73. The sinker 7 thus formed can be made integrally so that design and structure are simpler and more durable. Material cost also is lower, thus the price can be reduced to meet market requirements.

Figure 5:
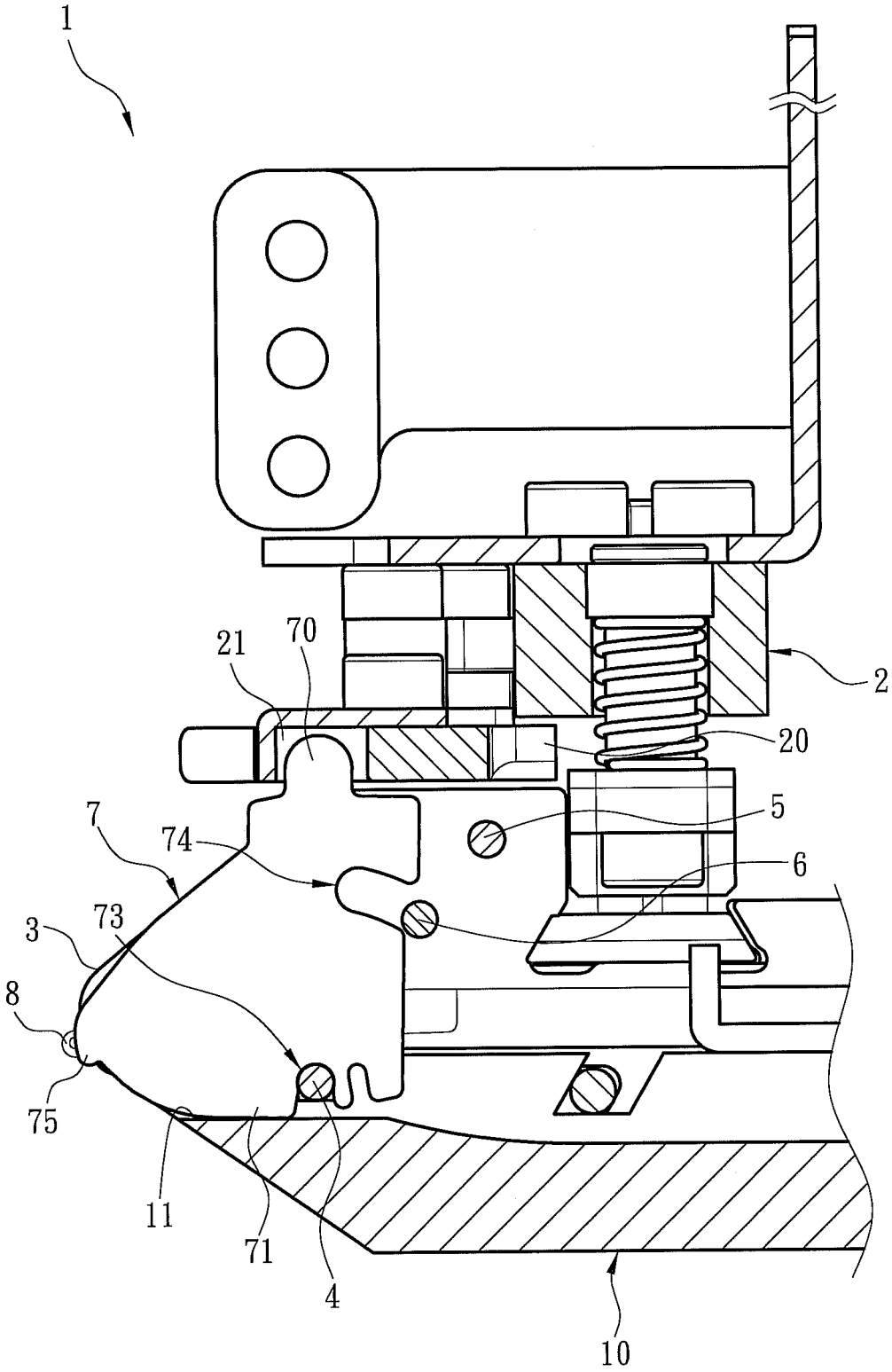
FIG. 5 is a schematic view of the sinker of an embodiment of the invention in a use condition.
Figure 6:
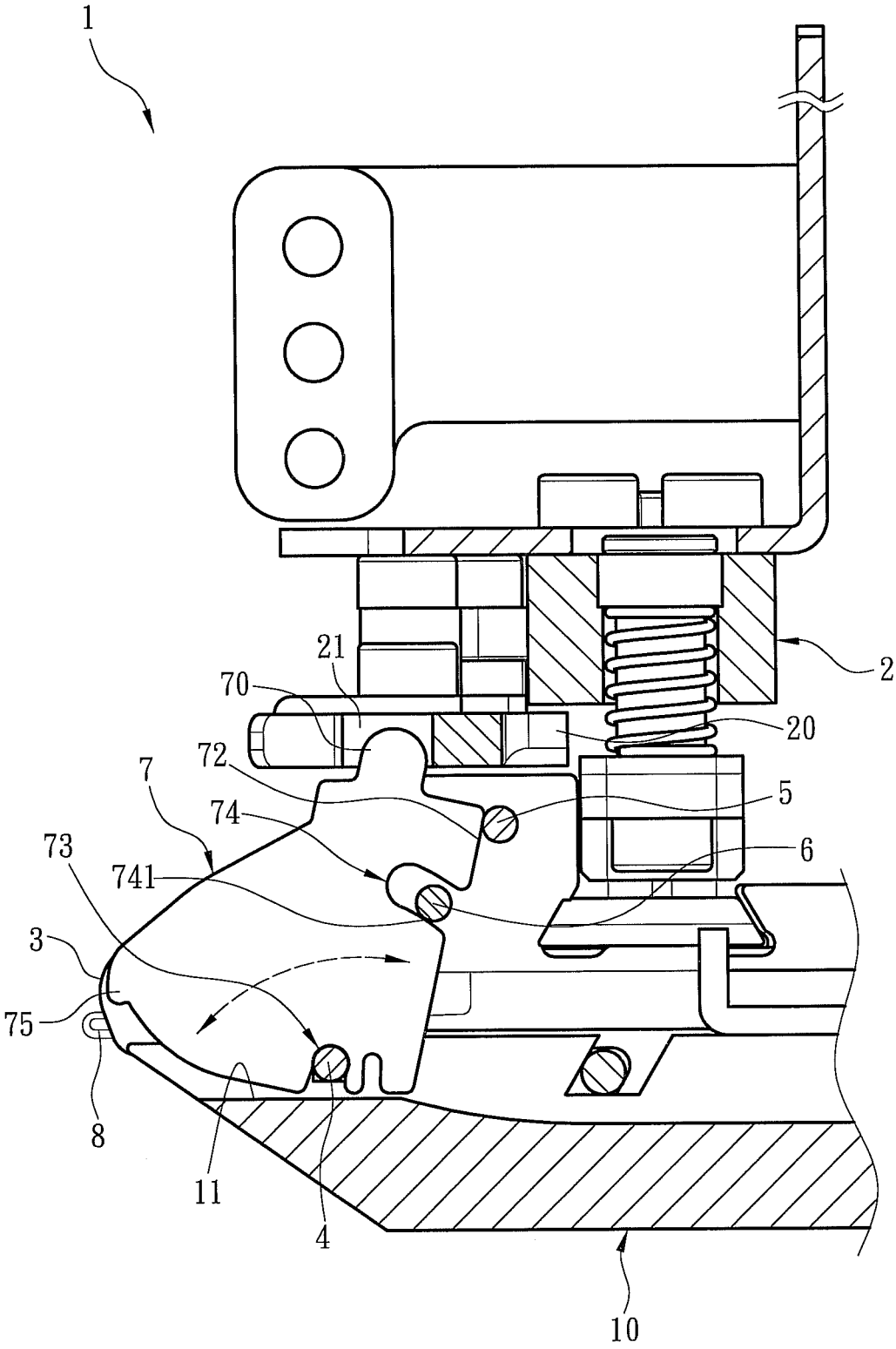
FIG. 6 is a schematic view of another use condition according to FIG. 5.

Please refer to FIGS. 5 and 6 for the invention in use conditions. As shown in FIG. 5, when the downward pressing mesh structure 1 is in operation, the cam holder 2 drives the cam 20 moving horizontally. As the swing guide portion 70 of the sinker 7 is held in the guide track 21, the sinker 7 is driven by the curvature formed by the guide track 21. Moreover, as the shaft rotating recess 73 is coupled on the bracing shaft 4, the sinker 7 swings about the bracing shaft 4 as shown in FIG. 6; meanwhile, the second retaining portion 72 is in contact with the retaining rod 5 to let the sinker 7 stop swinging. When the downward pressing mesh structure 1 continues operating, the cam holder 2 continuously drives the cam 20 moving horizontally, and the swing guide portion 70 is still driven by the curvature formed by the guide track 21 to swing back as shown in FIG. 5; meanwhile, as the first retaining portion 71 is in contact with the bearing surface 11 of the needle seat 10, the sinker 7 stops swinging. Thus the downward pressing mesh structure 1 can operate continuously and the cam 20 also is moved horizontally and continuously to drive all the sinkers 7 on the needle seat 10 to swing and press downward to form meshes.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A downward pressing mesh mechanism for flat knitting machines, comprising:

a needle seat including a bearing surface to hold a plurality of sinkers and knitting needles separated by spacers, and a cam holder located above the sinkers to hold a cam, the cam including a guide track to drive the sinkers swinging, the spacers being vertically run through by a bracing shaft at a lower side, each sinker including:

a yarn pressing portion for pressing a yarn to form a mesh;

a swing guide portion driven by the guide track; and a shaft rotating recess to couple with the bracing shaft;

wherein each sinker includes a groove close to the shaft rotating recess and an elastic tongue formed between the groove and the shaft rotating recess.

2. The downward pressing mesh mechanism of claim 1, wherein the shaft rotating recess includes a shaft coupling portion coupled with the bracing shaft and a neck located at an entrance of the shaft coupling portion and formed at an interval smaller than the diameter of the bracing shaft.

3. The downward pressing mesh mechanism of claim 1, wherein the spacers are vertically run through by a retaining rod at an upper side, each sinker including a first retaining portion restricted by the bearing surface during rotating and swinging downward thereof and a second retaining portion restricted by the retaining rod during rotating and swinging upward thereof.

4. The downward pressing mesh mechanism of claim 2, wherein the spacers are vertically run through by a retaining rod at an upper side, each sinker including a first retaining portion restricted by the bearing surface during rotating and swinging downward thereof and a second retaining portion restricted by the retaining rod during rotating and swinging upward thereof.

5. The downward pressing mesh mechanism of claim 1, wherein the spacers are vertically run through by a guiding rod, each sinker including a guiding notch which includes a guiding surface to guide and limit rotating and swinging positions of the sinker.

6. The downward pressing mesh mechanism of claim 2, wherein the spacers are vertically run through by a guiding rod, each sinker including a guiding notch which includes a guiding surface to guide and limit rotating and swinging positions of the sinker.

7. The downward pressing mesh mechanism of claim 4, wherein the spacers are vertically run through by a guiding rod, each sinker including a guiding notch which includes a guiding surface to guide and limit rotating and swinging positions of the sinker.

8. A sinker for flat knitting machines, comprising:

a shaft rotating recess at the bottom thereof, a swing guide portion extended outwards from an upper side thereof and a yarn pressing portion protruded from one side beyond a line connecting the swing guide portion and the shaft rotating recess to press a yarn to form a mesh, wherein the sinker further includes a groove close to the shaft rotating recess and an elastic tongue formed between the groove and the shaft rotating recess.

9. The sinker of claim 8, wherein the shaft rotating recess includes a shaft coupling portion and a neck located at an entrance of the shaft coupling portion and formed at an interval smaller than the maximum interval of the shaft coupling portion.

10. The sinker of claim 8 further including a first retaining portion located between the shaft rotating recess and the yarn pressing portion.

11. The sinker of claim 9 further including a first retaining portion located between the shaft rotating recess and the yarn pressing portion.

12. The sinker of claim 8 further including a guiding notch at another side beyond the line connecting the swing guide portion and the shaft rotating recess, the guiding notch including an arched guiding surface at a lower side, the guiding notch and the swing guide portion being interposed by a second retaining portion.

13. The sinker of claim 9 further including a guiding notch at another side beyond the line connecting the swing guide portion and the shaft rotating recess, the guiding notch including an arched guiding surface at a lower side, the guiding notch and the swing guide portion being interposed by a second retaining portion.

14. The sinker of claim 11 further including a guiding notch at another side beyond the line connecting the swing guide portion and the shaft rotating recess, the guiding notch including an arched guiding surface at a lower side, the guiding notch and the swing guide portion being interposed by a second retaining portion.

* * * * *